US009939183B2

(12) United States Patent
Ito

(10) Patent No.: US 9,939,183 B2
(45) Date of Patent: Apr. 10, 2018

(54) CONSTANT-TEMPERATURE-FLUID CIRCULATION DEVICE

(71) Applicant: SMC CORPORATION, Chiyoda-ku (JP)

(72) Inventor: Noriaki Ito, Tsukuba (JP)

(73) Assignee: SMC CORPORATION, Chiyoda-ku (JP)

( * ) Notice: Subject to any disclaimer, the term of this patent is extended or adjusted under 35 U.S.C. 154(b) by 118 days.

(21) Appl. No.: 14/904,158

(22) PCT Filed: Aug. 20, 2013

(86) PCT No.: PCT/JP2013/072151
§ 371 (c)(1),
(2) Date: Jan. 11, 2016

(87) PCT Pub. No.: WO2015/004821
PCT Pub. Date: Jan. 15, 2015

(65) Prior Publication Data

US 2016/0146519 A1 May 26, 2016

(30) Foreign Application Priority Data

Jul. 11, 2013 (JP) ..... 2013-145816

(51) Int. Cl.
*F25B 39/04* (2006.01)
*F28D 1/053* (2006.01)
(Continued)

(52) U.S. Cl.
CPC ..... *F25B 39/04* (2013.01); *F25B 6/04* (2013.01); *F28D 1/0417* (2013.01);
(Continued)

(58) Field of Classification Search
CPC ..... F25B 39/04; F25B 6/04; F25B 2700/195; F25B 2700/21151; F25B 2339/04;
(Continued)

(56) References Cited

U.S. PATENT DOCUMENTS 322,878 A * 7/1885 Winchell ..... A01D 78/02 56/373
2,486,226 A * 10/1949 Trask ..... F24F 1/025 62/289
(Continued)

FOREIGN PATENT DOCUMENTS

CN 1308717 A 8/2001
CN 1650143 A 8/2005
(Continued)

OTHER PUBLICATIONS

International Search Report dated Nov. 12, 2013, in PCT/JP2013/072151 filed Aug. 20, 2013.
(Continued)

*Primary Examiner* — Emmanuel Duke
(74) *Attorney, Agent, or Firm* — Oblon, McClelland, Maier & Neustadt, L.L.P.

(57) ABSTRACT

A device to mount plural number of condenser sections, including respective condenser sections of an inflow conduit flowing into coolant therein, an outflow conduit flowing out of coolant therefrom, a connection tube communicating between the inflow conduit and the outflow conduit, and plural number of condenser tubes for connecting the inflow conduit and the outflow conduit and fins attached to the condenser tube. The plural number of the condenser sections are mounted every inflow conduits and every outflow conduits directing to the same direction, leeward side positioned outflow conduits of the condenser sections and windward side positioned inflow conduits of the condenser sections being connecting the connection tube, with series connec-
(Continued)

tion, thereby coolant within the condenser tubes of the plural number of the condenser sections flows in the same direction.

8 Claims, 8 Drawing Sheets

(51) Int. Cl.

| | |
|---|---|
| ***F25B 6/04*** | (2006.01) |
| ***F28D 7/00*** | (2006.01) |
| ***F28F 9/00*** | (2006.01) |
| ***F28D 1/04*** | (2006.01) |
| *F28D 21/00* | (2006.01) |

(52) U.S. Cl.
CPC ..... *F28D 1/0435* (2013.01); *F28D 1/05383* (2013.01); *F28D 7/0008* (2013.01); *F28F 9/002* (2013.01); *F25B 2339/04* (2013.01); *F25B 2341/0661* (2013.01); *F25B 2400/0403* (2013.01); *F25B 2700/195* (2013.01); *F25B 2700/1931* (2013.01); *F25B 2700/1933* (2013.01); *F25B 2700/21151* (2013.01); *F28D 2021/007* (2013.01)

(58) Field of Classification Search
CPC ..... F25B 2700/1933; F25B 2400/0403; F25B 2341/0661; F25B 2700/1931; F25D 1/0435; F28D 1/0417; F28D 7/0008; F28D 1/05383; F28D 2021/007; F28F 9/002
See application file for complete search history.

(56) References Cited

U.S. PATENT DOCUMENTS

| | | | | |
|---|---|---|---|---|
| 6,442,951 | B1 | 9/2002 | Maeda et al. | |
| 2003/0106677 | A1 | 6/2003 | Memory et al. | |
| 2006/0081354 | A1* | 4/2006 | Miura | B62D 25/084 165/41 |
| 2008/0023173 | A1* | 1/2008 | Savage | B60H 1/00328 165/41 |
| 2010/0044007 | A1* | 2/2010 | Sensui | B60H 1/00535 165/67 |

FOREIGN PATENT DOCUMENTS

| | | | | |
|---|---|---|---|---|
| JP | 2000-81288 | A | | 3/2000 |
| JP | 2002-22337 | A | | 1/2002 |
| JP | 2002022337 | A | * | 1/2002 |
| JP | 2004-225961 | A | | 8/2004 |
| JP | 2008-89294 | A | | 4/2008 |
| JP | 2010-107103 | A | | 5/2010 |
| JP | 2010265809 | A | * | 11/2010 |
| JP | 2013072600 | A | * | 4/2013 |
| KR | 100917119 | B1 | * | 9/2009 |

OTHER PUBLICATIONS

Combined Chinese Office Action and Search Report dated Apr. 1, 2017 in Chinese Patent Application No. 201380078144.2 (with English translation of categories of cited documents).

* cited by examiner

CONSTANT-TEMPERATURE-FLUID CIRCULATION DEVICE

FIELD OF THE INVENTION

The present invention relates to constant-temperature-fluid circulation device for cooling or heating a load by supplying a liquid of regulated temperature to the load.

DESCRIPTION OF THE BACKGROUND ART

A circulation device of circulating constant-temperature-fluid for supplying a thermally regulated constant-temperature liquid for the sale of cooling or heating a load is conventionally known in the art such as shown Patent Document 1 and the like. The circulation device for constant-temperature liquid comprises a thermally regulated constant-temperature liquid circuit unit for supplying the constant-temperature liquid to a load, and a refrigeration circuit unit for regulating the constant-temperature liquid at a predetermined set temperature.

The refrigeration circuit unit comprises a compressor to produce a gaseous coolant of high temperature and high pressure of a coolant in gas phase, an air-cooled type condenser for generating high-pressure liquid coolant by cooling coolant in gas-phase fed from the compressor, a fan to supply cooling wind to the condenser, an expansion valve to form low temperature and low pressure liquid coolant by expanding the high-pressure liquid coolant supplied from the condenser, and an evaporator for supplying low pressure gaseous coolant to the compressor produced by the constant-temperature liquid being evaporated by making heat exchange with the low temperature and low pressure liquid coolant in the heat exchanging device.

As to conventional air-cooled type condenser, there are constructed, for example, by use of one or more meanderingly bent copper pipes within which is allowed to flow coolant mounted fins (meandering pipe type), or by use of inflow pipes and outflow pipes connected with plurality of tubes (condenser tubes) and being mounted fines between adjacent tubes (radiator type), etc.

Although the radiator type condenser is often applied for the constant-temperature-fluid circulation device due to compact in size and excellent cooling efficiency of coolant in comparison with the meandering pipe type condenser, it is demanded to improve the cooling facility of the liquid coolant in the refrigeration circuit unit, therefore, it is desired to improve the cooling efficiency of coolant by the condenser, or in other words, facilitating to cool by the condenser in further lower temperature of coolant. In addition, the circulation device of circulating constant-temperature-fluid is to be suppressed as much as possible.

PRIOR ART DOCUMENT

Patent Document

Patent Document 1: JP 2002-22337 A1

SUMMARY OF THE INVENTION

Problem to be Solved by the Invention

The object of the present invention resides, in a circulation device of circulating constant-temperature-fluid, to improve the cooling efficiency of a refrigeration circuit unit by enhancing cooling facility of an air cooling type condenser without enlarging the size thereof.

Means for Solving the Problem

In order to solve the foregoing problem, in accordance with the circulation device of circulating constant-temperature-fluid of the present invention comprises a housing comprising a constant-temperature liquid circuit unit for supplying thermally regulated constant-temperature to a load and a refrigeration circuit unit for regulating the temperature of the constant-temperature liquid by heat exchanging between the constant-temperature liquid and coolant, the refrigeration circuit unit comprising a compressor to form high-temperature and high-pressure gaseous coolant by compressing gaseous coolant, an air-cooled condenser for generating high-pressure liquid coolant by cooling coolant in gas-phase fed from the compressor, an expansion valve to form low temperature and low pressure liquid coolant by expanding the high-pressure liquid coolant supplied from the condenser, and an evaporator for supplying low pressure gaseous coolant to the compressor produced by the constant-temperature liquid being evaporated by making heat exchange with the low temperature and low pressure liquid coolant in the heat exchanging device.

The condenser comprising a fan generating coolant stream, and a plural number of condenser sections disposed along flow of coolant stream, respective condenser section having an inflow conduit flowing into coolant, an outflow conduit flowing out coolant, plural number of condenser tubes communicating between the inflow conduit and the outflow conduit, and fin mounted to the condenser tube, the plural number of the condenser sections being disposed directions of every inflow conduits and every outflow conduits to the same side of the housing, the inflow conduit disposed at the most leeward side being connected to the compressor by way of an inflow coolant conduit, the outflow conduit disposed at the most windward side being connected to the expansion valve by way of outflow coolant conduit, and the outflow conduit of the condenser positioned at the leeward side being connected to the windward side inflow conduit of the condenser section by means of a connection tube, the plural number of condenser sections being arranged in series, and coolant in the condenser tubes of the plural condenser flowing same direction.

In the present invention, condenser sections which are adjacently disposed with each other are preferably arranged to shift the longitudinal direction of the condenser tube, and the condenser section on the side of leeward position of cooling wind are also preferably disposed to protrude up to than the condenser section of windward position.

In the construction of the condenser sections, the preferable disposition of the inflow conduit is vertically upper side of the outflow conduit, thereby coolant in the vertical disposed condenser section flows downwardly.

According to specific variations of the construction in the present invention, the condenser has a rectangular fan shroud mounted a fan therein, and a condenser cover flowing coolant which is connected to the fan shroud, plural number of the condenser cover which are disposed within the condenser cover integrally, the inflow conduit placed at one end of the condenser cover and the outflow conduit placed at the other end of the condenser cover, further the inflow conduit and the outflow conduit of the adjacent condenser sections are connected each other by way of the connection tube disposed the one end side to the other end side at the outside of the condenser cover.

In this case, the condenser cover being disposed vertically, the inflow conduits disposed toward transverse direction at the upper portion of the condenser cover and the outflow conduits being disposed toward transverse direction at the lower portion of the condenser cover, respective one end of the outflow conduit and the inflow conduit are formed connection ports for connecting the inflow side coolant conduit, the outflow side coolant conduit and the connection tube to open outside of the condenser cover.

Effects of the Invention

In accordance with the present invention, since the condenser is so arranged as to dispose the plural number of condenser units to the same direction for allowing to flow toward the same direction of coolant in the condenser tubes of respective condenser units, the temperature of coolant in the windward direction is lower than that of leeward direction in the flow of cooling wind in the entire area, therefore, even if the temperature of the cooing air is increased at the windward in the condenser units by absorbing heat of coolant, coolant flowing in the condenser units is sufficiently cooling down toward the leeward direction, as a result, ensuring to cool coolant as a whole in the condenser units efficiently without irregularity, as a result being improved the cooling ability of the condenser units or cooling capacity of the refrigeration circuit unit. Further, the constant-temperature-fluid circulation device does not cause enlarging in size so as to improve the cooling efficiency without increasing the size of the condenser.

EMBODIMENT OF THE INVENTION

Figure 1:
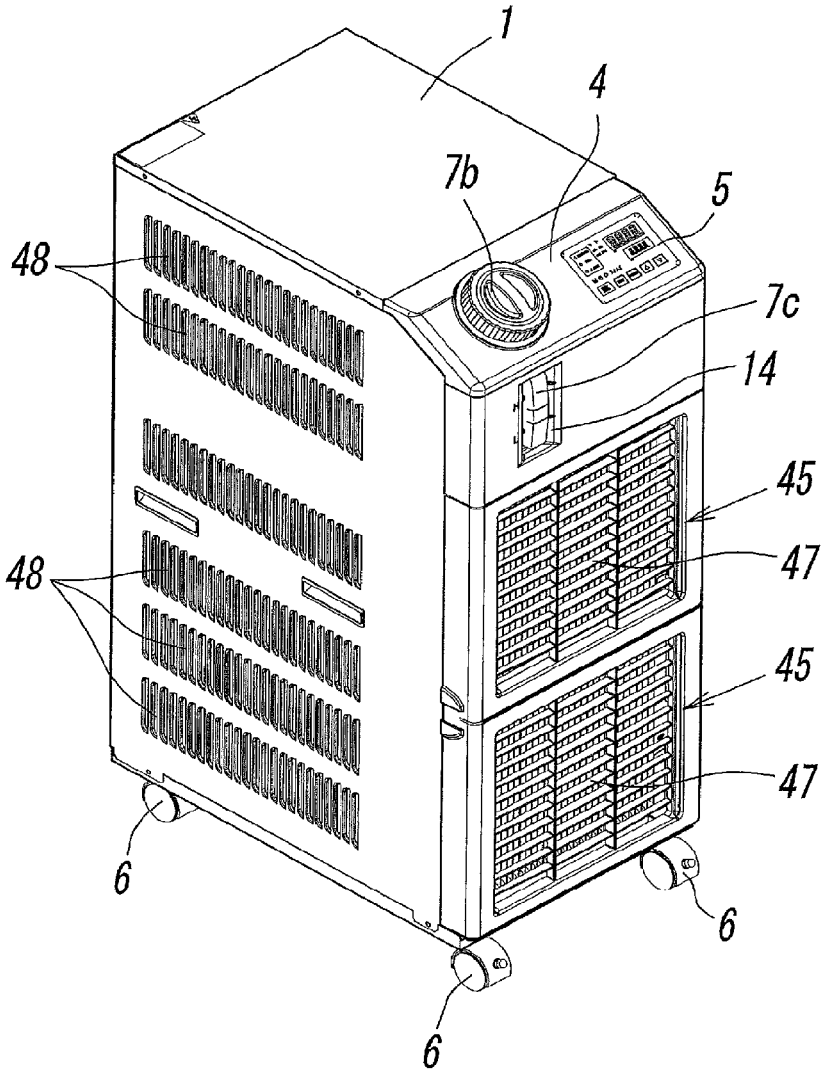
FIG. 1 is a perspective view showing an embodiment of a constant-temperature-fluid circulation device of the present invention.
Figure 2:
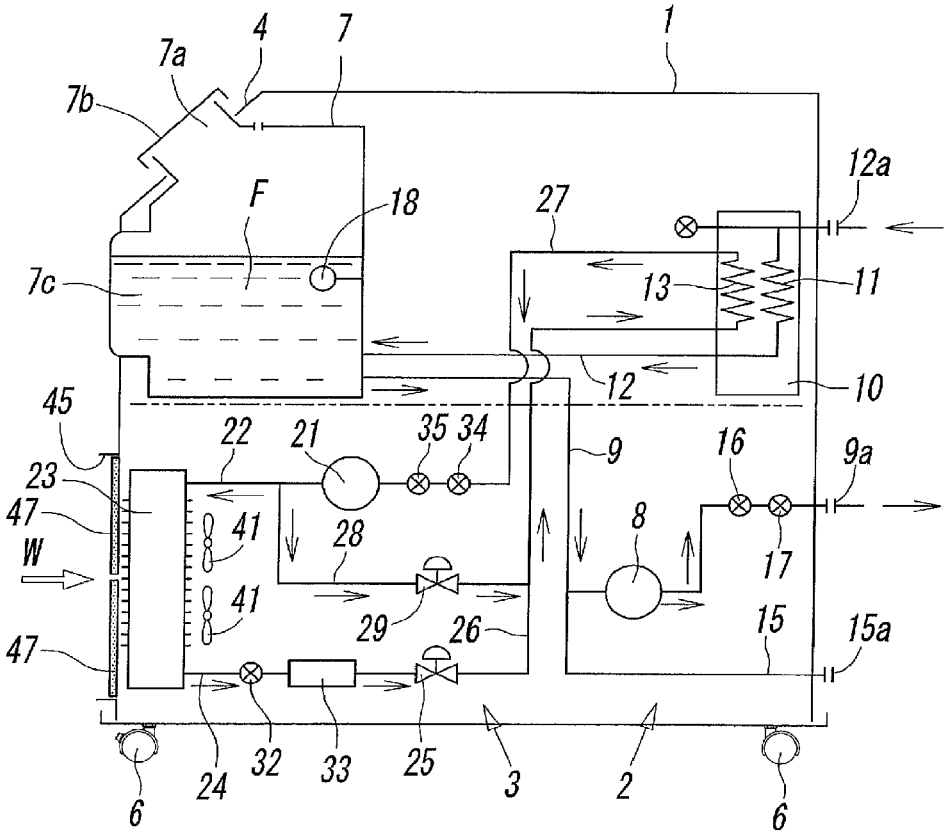
FIG. 2 is a schematic view of the inside of the constant-temperature-fluid circulation device as shown in FIG. 1
Figure 3:
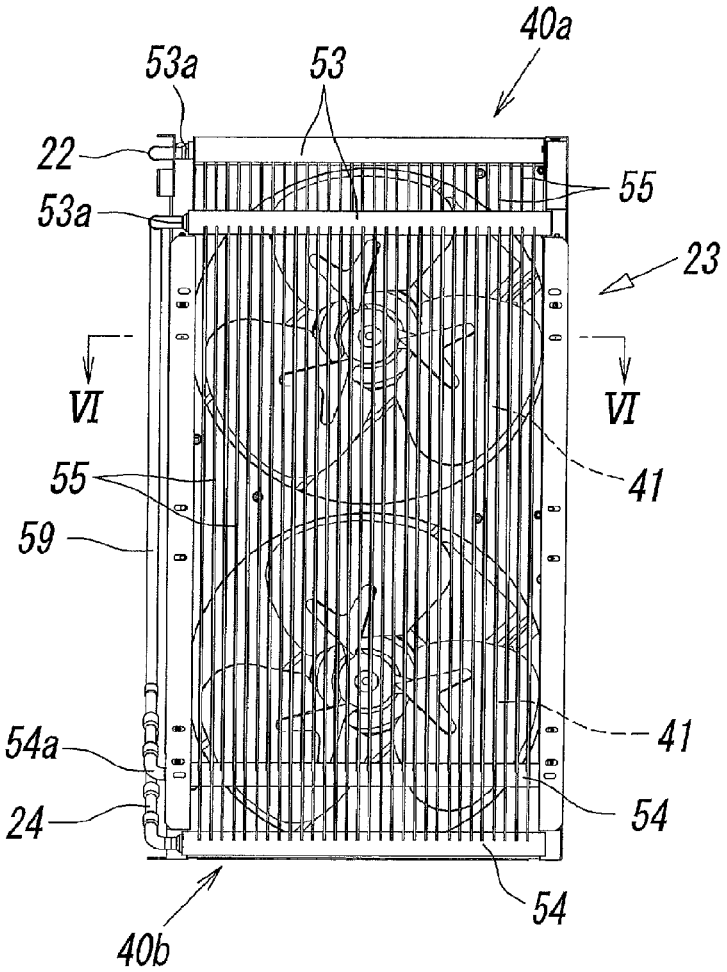
FIG. 3 is the front view of a condenser used in the constant-temperature-fluid circulation device of FIG. 1
Figure 4:
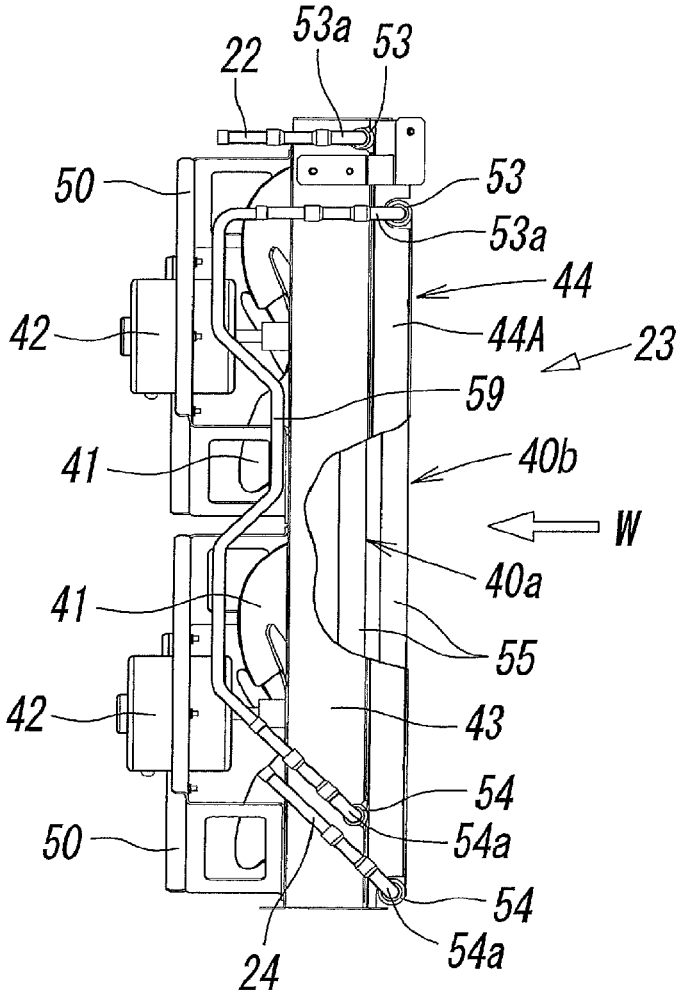
FIG. 4 is a partially raptured left side view the condenser of FIG. 3.
Figure 5:
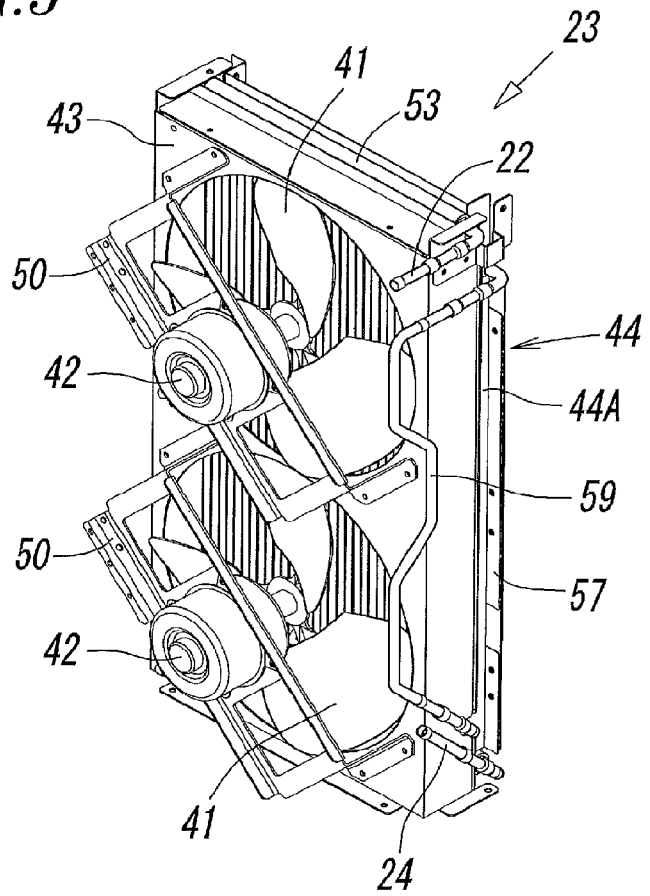
FIG. 5 is a perspective back view of the condenser of FIG. 3 looking from inclined upward direction.
Figure 6:
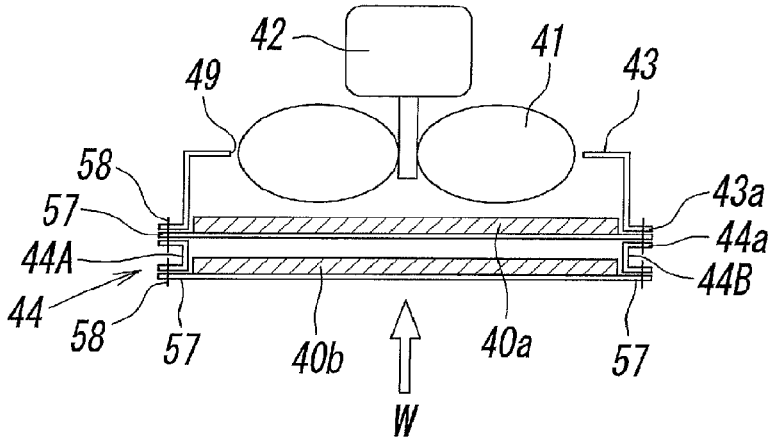
FIG. 6 is a cross-sectional view shown schematically along the line of VI-VI of the condenser of FIG. 3.

FIG. 1 shows an embodiment of a constant-temperature-fluid circulation device of the present invention. The constant-temperature-fluid circulation device comprises, as apparent from FIG. 2, a constant-temperature liquid circuit unit 2 for supplying thermally regulated constant-temperature liquid F to a load as circulating flow, and refrigerate circuit unit 3 for regulating temperature of the load by making heat-exchange to cool down with temperature risen the constant-temperature liquid F assembled in a metallic housing 1.

The housing 1 is configured in the form of a vertically elongated rectangular box, the front upper portion thereof being formed upwardly inclined wall portion 4, an operation panel being formed for performing on-off operation of the device, setting operation of the temperature of the constant-temperature liquid, displaying the temperature and pressure of the constant-temperature liquid, and the like are provided on the inclined wall portion 4.

Further, four position of the bottom of the housing 1 are mounted casters 6, thus the constant-temperature-fluid circulation device can be transferred to a required place by the caster 6.

The constant-temperature liquid circuit unit 2 comprises a transparent or semi-transparent tank 7 made of plastic resin, a pump 8 for supplying constant-temperature liquid F to the load through a discharge conduit 9, and a return conduit 12 provided within a heat-exchange apparatus 10 to return the constant-temperature liquid F through a temperature adjusting conduit 11 into the tank 7. The temperature adjusting conduit 11 is adapted to adjust the constant-temperature liquid F which is risen the temperature by cooling the load to keep a predetermined temperature by means of heat-exchanging with coolant in the course of flowing in an evaporator 13 of the refrigerate circuit unit 3.

The tank 7 is placed at the position of the front upper portion in the housing 1, and a liquid filling port 7*a* is opened at the inclined wall portion 4 of the housing 1, the liquid filling port 7*a* being detachably mounted with a cap 7*b*. Further, a vertically elongated liquid level gage 7*c* is provided at a side wall of the tank 7, the liquid level gage 7*c* being exposed outside from an elongated window formed at the front wall of the housing 1, thereby being facilitated to confirm the liquid level of the constant-temperature liquid F in the tank 7 from outside of the housing 1.

An outlet port 9*a* as the end of the discharge conduit 9 and a return port 12*a* as the end of the return conduit 12 are formed at the back side of the housing 1, thereby respective pipes connecting from the load adapted to connect with the outlet port 9*a* and the return port 12*a*, respectively.

In addition, a drain conduit 15 is diverged from the discharge conduit 9 at the upstream from the pump 8, the discharge conduit 9 being opened as a drain port 15*a* at the back side of the housing 1.

Further, a temperature sensor 16 for the constant-temperature liquid and a pressure sensor 17 for the constant-temperature liquid are connected to the discharge conduit 9 at the downstream side of the pump 8. In the drawings, 18 denotes a level switch provided in the tank 7.

On the other hand, the refrigeration circuit 3 comprises, to arrange in series and in cyclic disposition of, a compressor 21 for compressing gaseous coolant to make high-temperature and high-pressure gaseous coolant, an air cooling type condenser 23 for cooling the high-temperature and high-pressure gaseous coolant from the compressor 21 through a coolant inflow conduit 22 to generate low-temperature and high-pressure liquid coolant, a first expansion valve 25 for forming low-temperature and low-pressure liquid coolant by expanding low-temperature and high-pressure liquid coolant fed by way of an outflow coolant conduit 24 from the condenser 23, and an evaporator 13 for producing low pressure liquid coolant by heat exchanging the low-temperature and low-pressure liquid coolant fed from the first expansion valve 25 through a low pressure side first coolant conduit 26, the thus produced low-pressure gaseous coolant feeding to the compressor 21 through a low pressure side second coolant conduit 27.

A bypass coolant conduit 28 is connected at opposite ends to coolant inflow conduit 22 and the low pressure side first coolant conduit 26, and a second expansion valve 29 is also connected to the bypass coolant conduit 28. The second expansion valve 29 has functions such as for adjusting the cooling efficiency of the heat exchanging device 10 to increase the temperature of coolant that high-temperature and high-pressure coolant gas is partially supplied to the first coolant conduit 26 flowing low-temperature and low-pressure between the first expansion valve 25 and the evaporator 13, thus adjusting temperature the liquid coolant passing through in the first coolant conduit 26, adjusting the pressure of coolant in the high pressure side of the refrigerate circuit unit 3, or the like.

In this connection, it is preferred that the first expansion valve 25 and the second expansion valve 29 constitute electronic expansion valves adapted to adjust the opening area.

The outflow coolant conduit 24 is connected a first pressure sensor 32 to detect the pressure of the high-pressure side coolant of the refrigeration circuit 3 and a filter 33 to remove contaminants from coolant, while the low pressure side second coolant conduit 27 is connected a second pressure sensor 34 for detecting the pressure of the low-pressure side coolant of the refrigeration circuit 3 and a coolant temperature sensor 35 to detect the temperature of coolant.

In this connection, the high-pressure side is a portion from the outlet of the compressor 21 to the inlet of the first expansion valve 25 through the condenser 23, while the portion from the first expansion valve 25 to the inlet of the compressor 21 through the evaporator 13 being the low-pressure side.

The condenser 23 is a one body air cooling type condenser as sown in FIG. 3 to FIG. 6, which is assembled into one body consisting of a fan shroud 43 made of metal built in the fan 41 and the fan motor 42, and a condenser cover 44 fixed plural number of the condensing section 40*a*, 40*b*, for the sake of generating cooling wind W from the fan 41 driven by the fan motor 42 for supplying coolant toward the plural number of condensing sections 40*a*, 40*b*, thereby cooling down and condensing coolant.

The condenser 23 is detachably mounted in the housing 1 at the front lower side to be disposed the fan 41 inner direction adapted to introduce outside air from an intake opening 45 as cooling wind W into the inside of the housing 1, cooling wind W being discharged from an exhaust port (not shown) after cooling coolant flowing in the condenser sections 40*a* and 40*b*. A dustproof filter 47 is mounted in the intake opening 45 of the housing 1. Also, the left and right sides of the housing 1 make to cut and raise to form plural vents 48 so that the cooling wind W is discharged from the vents 48.

The construction of the condenser 23 is explained in more detail. The condenser 23 is consisting of two unit of the fan 41 and fan motor 42, and plural number of the condenser sections 40*a*, 40*b*. The embodiment shown has two set of the condenser sections 40*a* and 40*b* are disposed in two story, at the windward side and the leeward side of the cooling wind W. Therefore, the leeward side condenser section 40*a* is called as a first condenser section, and the windward side condenser 40*b* is called as a second condenser section, as needed hereinafter.

The fan shroud 43 vertically elongated rectangular framework which has vents 49 at upper and lower in the back side thereof. Fans 41 is provided at the position of respective vent 49, and the fan motors 42 for driving the fan 41 is fixed with fitting member 50 at the backside position the fan 41.

On the other hand, the condenser cover 44 consists of a pair of left and right cover members 44 A and 44B connected to the left side and right side surfaces of the fan shroud 43 by means of screw or the like, the condenser sections 40*a*, 40*b* being mounted between the pair of the cover members 44A, 44B at the windward side and the leeward side of the cooling wind W so as to be adjacent not to contact each other with keeping a small space. Therefore, as shown with arrow in FIG. 2 and FIG. 4, the cooling wind W blowing from the fan 41 is sucked from the front side of the condenser cover 44 into the condenser cover 44 to make cooling coolant during passing through two condenser sections 40*a*, 40*b*, then discharging out of the back side of the fan shroud 43.

The condenser cover 44 may be a complete rectangular frame work as a whole in addition to the left and right side cover members 44A, 44B.

Figure 7:
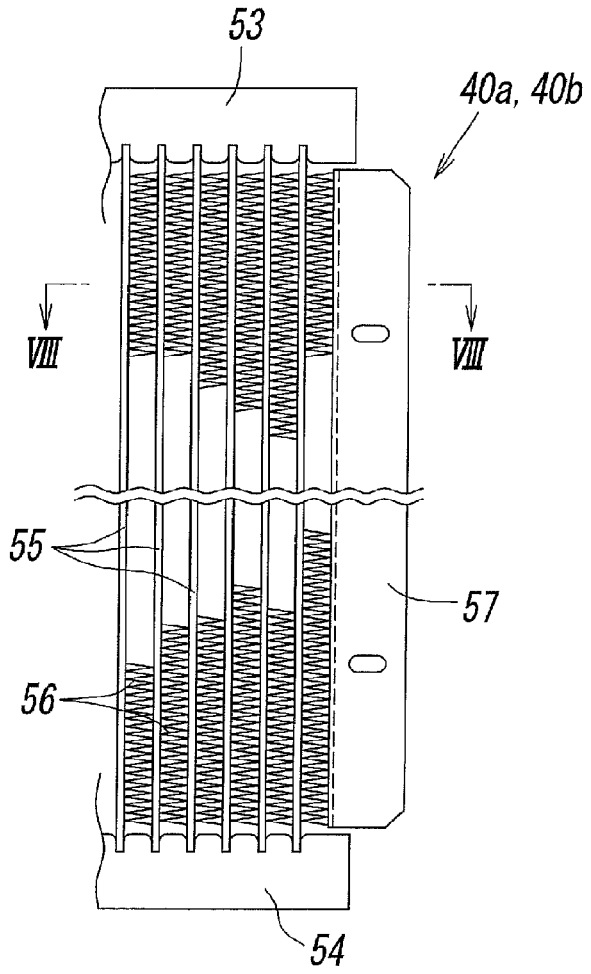
FIG. 7 is a partially enlarged view of a condenser unit used in the condenser of FIG. 3.
Figure 8:
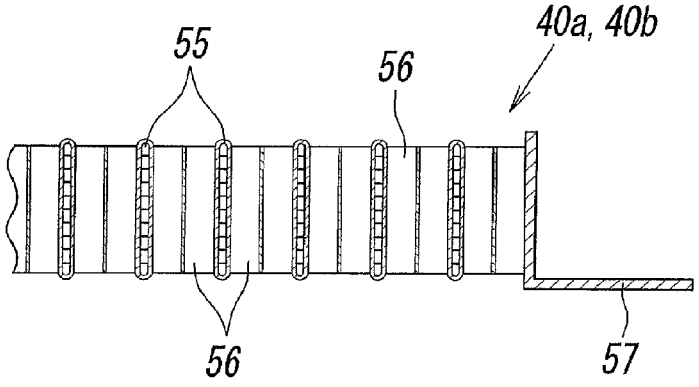
FIG. 8 is a cross-sectional view along the line of VIII-VIII of FIG. 7.

The two sets of the condenser sections 40*a* and 40*b* have substantially same construction, as apparent from FIG. 7 and FIG. 8, that an inflow conduit 53 for flowing into coolant provided one end of which is disposed between the condenser sections 40*a*, 40*b*, a outflow conduit 54 for flowing out coolant provided the other end of which is disposed between the condenser sections 40*a*, 40*b* arranged in parallel to the inflow conduit 53, plural number of condenser conduits 55 arranged in parallel with each other for communicating between the inflow conduit 53 and the outflow conduit 53, and radiation fins 56 fixed to the condenser conduits 55. The condenser conduit 55 is constructed as an elongated flat tube having hollow passage therein, preferably formed inner fin within the hollow passage. By the way, the fin 56 is omitted from FIG. 3.

Further, narrow plate like mounting stays 57 are mounted between one and the other portions of the inflow conduit 53 and the outflow conduit 54 consisting of the condenser sections 40*a*, 40*b*, these stays 57 being fixed with screw to mounting portions 43*a*, 44*a* of the fan shroud 43 and the condenser cover 44.

The inflow conduit 53 is disposed transversely on the top portion of the condenser cover 44, while the outflow conduit 54 being disposed transversely at the bottom portion of the condenser cover 44, further the condenser conduit 55 is extended vertically (up and down direction) within the condenser cover 44. The inflow conduit 53 and the outflow conduit 54 form connection ports 53*a* and 54*a* at respective one end, while the other ends of the inflow conduit 53 and the outflow conduit 54 are closed. Further, the connection port 54*a* of the outflow conduit 54 to the first condenser section 40*a* and the connection port 53*a* of the inflow conduit to the second condenser section 40*b* are bring into communication each other with a connection conduit 59 disposed out of the side of the condenser cover 44, thereby the two sets of the condenser sections 40*a*, 40*b* are connected each other in series, thus allowing to flow coolant downstream to the same direction within the condenser conduits 55 of the two set of condenser sections 40*a* and 40*b*.

In this connection, with respect to the connection port 54*a* of the outflow conduit 54 of the first condenser section 40*a* and the connection port 53*a* of the inflow conduit 53 of the second condenser section 40*b*, one is opened outside to one cover member 44A, the other being opened outside to the other cover member 44B.

Further, the connection port 53*a* of the inflow conduit 53 for the first condenser section 40*a* which is positioned leeward side of cooling wind W is connected with the compressor 21 by way of coolant inflow conduit 22, and the connection port 54*a* of the outflow conduit 54 at the windward side for the second condenser section 40*b* is connected to the first expansion valve 25 by way of coolant outflow conduit 24. In this case, as an actual circuit construction, the pressure sensor 32, the filter 33 and the like are connected between the connection port 54 of the outflow conduit 54 and the first expansion valve 25, the forgoing explanation includes that the pressure sensor 32, the filter 33 and the like may be connected with indirect manner between the connection port 54 of the outflow conduit 54 and the first expansion valve 25.

In addition, the two sets of the condenser sections 40*a*, 40*b* are mounted on the condenser cover 44 by slightly shifting the position each other in the direction of the condenser conduit 55. The embodiment, thus shown in the figures, the first condenser section 40*a* is slightly protruded upwardly than the second condenser section 49*b*. Therefore, it can be accomplished connecting works of the connection conduit 59, the inflow coolant conduit 22 and coolant outflow conduit 24 with the inflow conduit 53 and the outflow conduit 54 without causing the conflict of these conduit, at the time of connecting due to shifted the positions between the inflow conduit 53 and outflow conduit 54 of two sets of the condenser sections 40*a*, 40*b*, and between the inflow conduit 54 and the outflow conduit 54. However, the two sets of the condenser sections 40*a* and 40*b* may not be moved, when these conduits do not be conflicted.

Figure 9:
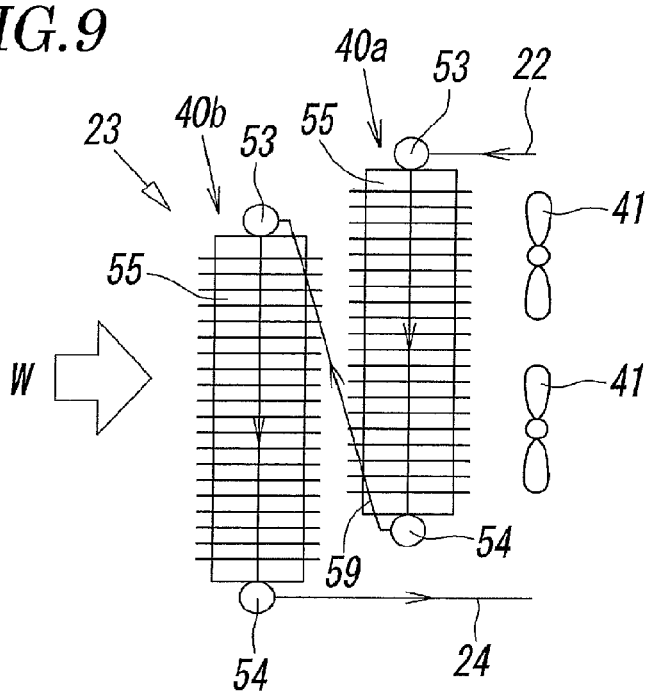
FIG. 9 is a schematic view explaining schematically of the cooling function of a coolant in the condenser.

In connection with the condenser 23 of the above-mentioned construction, as shown in FIG. 9, high-temperature and high-pressure gaseous coolant, which is introduced into the inflow conduit 53 disposed at upper portion of the first condenser section 40*a* from the compressor 21 through the inflow conduit 22 from the compressor 21, flows downward direction gradually in disperse state the plural number of condenser conduit 55 of the first condenser section 40*a* from the inflow conduit 53, in the course of flow coolant being cooled down and being condensed by the cooling air W generated from the fan 41, thus resulting low-temperature and high-pressure liquid coolant to flow out toward the outflow conduit 54 placed at the lower portion of the second condenser section 40*b*. The liquid coolant is fed to the first expand valve 25 through the outflow conduit 53 and the outflow side cooling liquid conduit 24.

In this instance, in comparison with the temperature of coolant in the down flow of the condenser conduit 55 of the pair of the first condenser section 40*a* and in the clown flow of the condenser conduit 55 of the second condenser section 40*b* at respective corresponding places of the vertical direction (direction of coolant flow), coolant temperature on the part of the windward coolant temperature in the condenser section 55 of the second condenser section 40*b* is lower than coolant temperature on the part of the leeward coolant temperature in the condenser section 55 of the first condenser section 40*a* at any position by all means. Therefore, even if the cooling wind W is risen the temperature by absorbing heat of coolant in the course of passing through the windward second condenser conduit 55, the temperature of the cooling wind W can be kept lower than coolant anywhere of the vertical direction in the first condenser section 55 of the condenser section sufficiently, thus facilitating to cool down in the first condenser section 40*a* certainly with no difficulty.

As explained above, since the two sets condenser sections 40*a*, 40*b* of the condenser 23 are disposed overlapped with each other in the same flow direction of coolant in these condenser tubes 55, the temperature of coolant can be cool down more than the conventional constructions such as provided one set of the condenser section, or disposed the cooling tube in a meander pattern, as a result improving the cooling ability of the refrigeration circuit unit 3. Further, the constant-temperature-fluid circulation device can be minimized due to not necessary to elongate linearly of the condenser tube 55 for improving the cooling facility.

In addition, since the top of the inflow conduit 53 of the first condenser section 40*a* and the condenser tube 55 are protruded upwardly in comparison with the second condenser section 40*b* by sifting the positions of the two sets of the condenser sections 40*a*, 40*b*, low temperature cooling air W which does not blow through the second condenser section 40*b* does expose directly to the protruded portion, thereby ensuring temperature coolant in the condenser tube 55 to be efficiently cooled by means of cooling wind W at the place of around upper portions of the inflow conduit 53 and condenser tube 55, thereby also leading the cooling efficiency.

Figure 10:
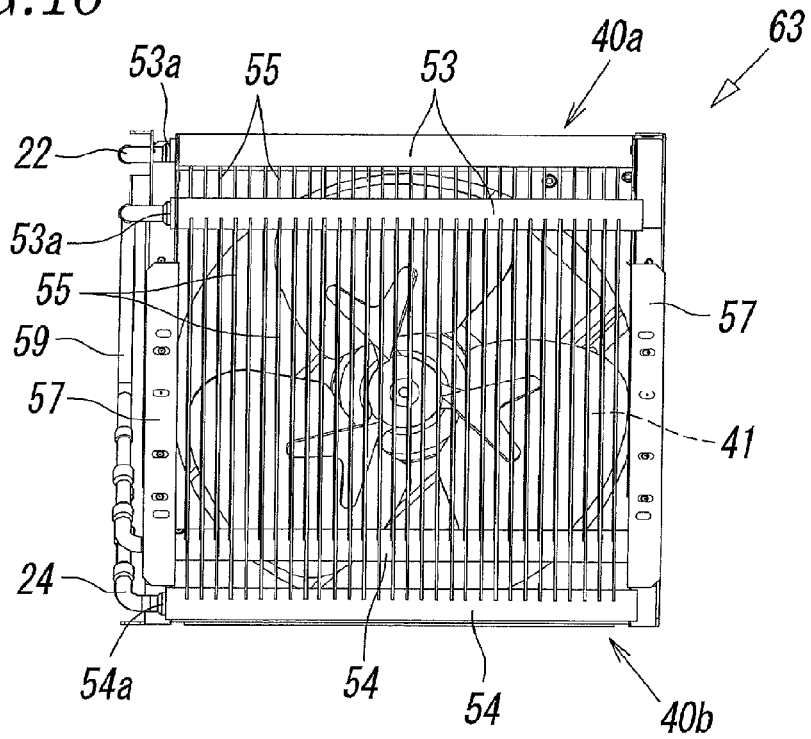
FIG. 10 is a front view showing another embodiment of a constant-temperature-fluid circulation device of the present invention.
Figure 11:
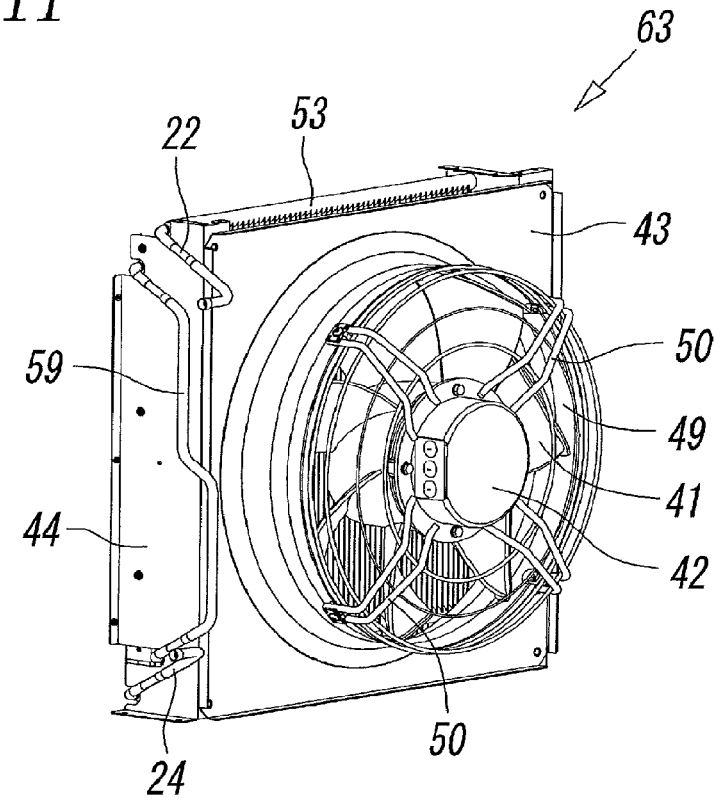
FIG. 11 is a perspective back view of the condenser of FIG. 9 looking from obliquely upward direction.

FIGS. 10 and 11 shows a condenser 63 of a second embodiment, the condenser 63 is different form the first embodiment of FIGS. 3-6 by constituting one fan 41 and a fan motor 42. Therefore, the circulation device of circulating constant-temperature-liquid (not shown) having the condenser 63 of the second embodiment is smaller in height than the circulation device of circulating constant-temperature-liquid as shown in FIG. 1.

Hereinafter, the construction of the condenser 63 of the second embodiment is explained briefly by use of the same reference numerals with the reference numerals used in the first embodiment.

The condenser 63, the fan shroud 43 and the condenser cover 44 is formed a square shape view from the front. Center portion of the back side in the fan shroud 43 is attached a cylindrical vent 49, the fan 41 is mounted in the vent 49, and the fan motor 42 is fixed to the fan shroud 43 with four mounting brackets formed linear form with folded to V shape.

Further, the condenser cover 44 is mounted to the two sets of first and second condenser sections 40*a*, 40*b* and the dispositions, mounting methods and the like thereof are similar to the condenser 23 of the first embodiment. However, difference resides in the mounting directions of the inflow conduit 53 and the outflow conduit 54 of the condenser sections 40*a*, 40*b* to the connection tube 59, the inflow coolant conduit 22 and the outflow coolant conduit 24. That is, in the case of the condenser 23 of the first embodiment, the inflow conduit 53 and the outflow conduit 54 are mounted on the left side in view from front side, and also view from left side the inflow conduit 53 and the outflow conduit 54 are connected to each other by way of the connection tube 59, also are connected the inflow side coolant conduit 53 and outflow conduit 54, while on the other hand, in the case of the condenser 23 according to the second embodiment, unlike to the first embodiment, the connection ports 54*a* of the inflow conduit 53 and the outflow conduit 54 are connected each other at the right side view from the front of the condenser cover 44, and the inflow coolant conduit 22 and the outflow conduit 23 are connected each other by the connection tube 59.

Since other than the forgoing constructions of the second embodiment are not different from the first embodiment, essential component parts are denoted same reference numeral with reference to the condenser 23 of the first embodiment and are omitted detailed explanation.

In the condensers 23, 63 of respective embodiments, the inflow conduit 53 and the outflow conduit 54 are disposed in parallel at the top and bottom of the condenser cover 44, and coolant being let run vertically from the upper portion of the condenser tube 55, the inflow conduit 53 and the outflow conduit 54 may be disposed vertically at the left side and right side of the condenser cover 44, while coolant being let run transversally in the condenser tube 55. Further, the connection ports 54*a* of the inflow conduit 53 and the outflow conduit 54 may direct either upwardly or downwardly, and the connection port 54*a* of the inflow conduit 53 and the connection port 54*a* of the outflow conduit 54 may be reversely arranged to each other.

Further, the two sets of condenser sections 40*a* and 40*b* have same construction and size in respective embodiments, the construction and/or size of the condenser sections 40*a* and 40*b* may be different to each other. For example, the two condenser sections 40*a* and 40*b* may be differentiated in longitudinal lengths, that is each of the condenser tubes 55 may be used different diameter, different number, or the like. In a case to use different length (size) condenser sections 40*a* and 40*b*, short sized condenser section is preferably disposed to the windward position.

Furthermore, condensers 23, 63 have two sets of the condenser sections 40*a* and 40*b* in accordance with respective embodiments, the number of condenser section may be three sets or more. In case of such constructions the all condenser sections may have the same construction, or may have different construction and/or size partially or fully condenser sections. And, in a case where all condenser sections constitute the same size and those positions are arranged to shift to longitudinal direction, all condenser tubes 55 condenser sections may be arranged to shift same direction, or to shift mutually in reverse. Or otherwise, it is not shift the disposition to completely overlapped toward the flowing direction of cooling wind W in a case where connecting the inflow conduit 53 and outflow conduit 54 with the connection tube 59, the inflow side coolant conduit 22 and outflow side coolant conduit 23 can be performed without confliction.

DESCRIPTION OF REFERENCE NUMERALS

1 housing
2 constant-temperature liquid circuit unit
3 refrigeration circuit unit
13 evaporator
21 compressor
22 coolant inflow conduit
23,63 condenser
24 coolant outflow conduit
25 expansion valve
40*a*, 40*b* condenser section
41 fan
43 shroud
44 condenser cover
53 inflow conduit
53*a* connection port
54 outflow conduit
54*a* connection port
55 condenser conduit
56 fin
59 connection tube
F constant-temperature liquid
W cooling wind

The invention claimed is:

1. A constant-temperature-fluid circulation device mounted within a housing, the device comprising:

a constant-temperature liquid circuit to supply thermally regulated constant-temperature liquid to a load; and a refrigeration circuit to regulate a temperature of the constant-temperature liquid by heat exchanging between the constant-temperature liquid and coolant, the refrigeration circuit comprising:

a compressor to form high-temperature and high-pressure gaseous coolant by compressing gaseous coolant, an air-cooled condenser to generate high-pressure liquid coolant by cooling coolant in gas-phase fed from the compressor, an expansion valve to form low temperature and low pressure liquid coolant by expanding the high-pressure liquid coolant supplied from the condenser, and an evaporator to supply low pressure gaseous coolant to the compressor produced by the constant-temperature liquid being evaporated by making heat exchange with the low temperature and low pressure liquid coolant in a heat exchanging device, the condenser comprising a fan shroud installed with a fan generating coolant stream, and a condenser cover functioning as a mounting stay connected to the fare shroud at leeward side, the condenser cover comprising left and right cover members and plural mounting portions being formed in the respective left and right cover members so as to be positioned at windward side sand leeward side, and plural condenser sections being mounted on the mounting portions toward a stream of cooling wind, the plural condenser sections comprising inflow conduits to flow into coolant, outflow conduits to flow out coolant and condenser tubes to communicate between the inflow conduits and the outflow conduits, the condenser tubes communicating between the inflow conduit and the outflow conduit, fins mounted to the condenser tube, and stays mounted toward orthogonal direction at both sides and extending in parallel with the condenser tubes, and the condenser sections being mounted on the condenser cover by fixing the stays to the mounting portions of the left and right cover members of the condenser cover with screws, the plural condenser sections being integrally disposed every inflow conduits and every outflow conduits directed to a same side of the housing, the inflow conduit disposed at a most leeward side being connected to the compressor by an inflow coolant conduit, the inflow conduit disposed at a most windward side being connected to the expansion valve by an outflow coolant conduit, and the outflow conduit of the condenser positioned at the leeward side being connected to the windward side inflow conduit of the condenser section by a connection tube, the plural condenser sections being arranged in series, and coolant in the condenser tubes of the plural condenser flowing in a same direction.

2. The constant-temperature-fluid circulation device according to claim 1, wherein the adjacent condenser sections are disposed shifted from each other toward the direction of the condenser tubes.

3. The constant-temperature-fluid circulation device according to claim 1, wherein the condenser section placed at the leeward side of the cooling wind is protruded toward the inflow conduit more than the condenser section at the windward side.

4. The constant-temperature-fluid circulation device according to claim 1, wherein the condenser section is disposed vertically to place the inflow conduit on an upper side and the outflow conduit on lower side to flow coolant downwardly in the longitudinally extended condenser tube.

5. The constant-temperature-fluid circulation device according to claim 1, wherein the plural condenser sections are disposed for the inflow conduit on one side of the condenser cover and the outflow conduit on an other side of the condenser cover, such that the adjacent outflow conduit and inflow conduit connected to the condenser cover are connected each other by the connection tube disposed outside of the condenser cover from one side to the other side.

6. The constant-temperature-fluid circulation device according to claim 5, wherein the adjacent condenser sections are mounted to the condenser cover shifted from each other toward the longitudinal direction of the condenser tubes.

7. The constant-temperature-fluid circulation device according to claim 6, wherein the condenser section is positioned leeward side of cooling wind protruding on the side of inflow conduit more than the windward side condenser section.

8. The constant-temperature-fluid circulation device according to claim 5, wherein the condenser cover is positioned vertically, the inflow conduits of the plural condenser section are positioned transversally at the upper position of the condenser cover, the outflow conduits positioned lower than the condenser cover, the condenser tubes are vertically disposed within the condenser cover, connection ports are formed on one end of the inflow conduit and the outflow conduit to connect the inflow side coolant conduit, outflow side coolant conduit and the connection tribes being open outside the condenser cover.

* * * * *